US010882658B2

(12) United States Patent
Piech

(10) Patent No.: US 10,882,658 B2
(45) Date of Patent: Jan. 5, 2021

(54) METALLIC CAN AND ASSOCIATED CAN LID

(71) Applicant: Gregor Anton Piech, Ellmau (AT)

(72) Inventor: Gregor Anton Piech, Ellmau (AT)

(73) Assignee: Gregor Anton Piech, Ellmau (AT)

( * ) Notice: Subject to any disclaimer, the term of this patent is extended or adjusted under 35 U.S.C. 154(b) by 0 days.

(21) Appl. No.: 16/317,381

(22) PCT Filed: May 19, 2017

(86) PCT No.: PCT/EP2017/062098

§ 371 (c)(1),
(2) Date: Jan. 11, 2019

(87) PCT Pub. No.: WO2018/010877

PCT Pub. Date: Jan. 18, 2018

(65) Prior Publication Data

US 2019/0241309 A1 Aug. 8, 2019

(30) Foreign Application Priority Data

Jul. 14, 2016 (DE) ..... 10 2016 112 953

(51) Int. Cl.
*B65D 17/28* (2006.01)

(52) U.S. Cl.
CPC ..... *B65D 17/4012* (2018.01); *B65D 17/404* (2018.01); *B65D 2517/0013* (2013.01); *B65D 2517/0082* (2013.01)

(58) Field of Classification Search
CPC ..... B65D 17/4012; B65D 17/404; B65D 2517/0082; B65D 2517/0013
USPC ..... 220/269–271
See application file for complete search history.

(56) References Cited

U.S. PATENT DOCUMENTS 3,344,946 A * 10/1967 Sprague ..... B65D 17/462 220/270
3,447,713 A * 6/1969 Stec ..... B65D 17/4011 220/273
3,701,453 A * 10/1972 Platt ..... B65D 17/508 220/270
3,762,598 A * 10/1973 Gayner ..... B21D 51/383 220/273

(Continued)

FOREIGN PATENT DOCUMENTS

CA 2412518 A1 1/2002
CN 105568085 A * 5/2016

(Continued)

*Primary Examiner* — James N Smalley

(57) ABSTRACT

A can lid that comprises an opening region provided in the material of the lid surface and comprises a two-armed lever member that is intended to open this opening region and that is connected to the lid material, wherein this arrangement is characterized in that the opening region configured as a tongue tab is delineated from the lid surface by a tear line and the tongue tab base connected to the lid surface forms a pivot bearing that becomes effective during the opening procedure; in that the lower side of the lid is coated with a plastic material in a firmly adhering manner, and this coating of the tear line that covers the tear line is weakened in an adjacent manner; and in that the container part and the can lid at least substantially comprise the same aluminum alloy.

20 Claims, 2 Drawing Sheets

(56) References Cited

U.S. PATENT DOCUMENTS

| | | | | |
|---|---|---|---|---|
| 4,609,123 | A * | 9/1986 | Poncy | B65D 17/4011 220/270 |
| 4,887,732 | A * | 12/1989 | Matsubayashi | B21D 51/44 220/269 |
| 5,411,159 | A * | 5/1995 | Fan | B65D 17/4012 220/269 |
| 5,770,290 | A * | 6/1998 | McHenry | B21D 51/383 428/43 |
| 8,985,371 | B2 | 3/2015 | Zabaleta et al. | |
| 2003/0062370 | A1 | 4/2003 | Ball et al. | |
| 2004/0140237 | A1* | 7/2004 | Brownewell | B21D 51/26 206/503 |
| 2012/0175371 | A1* | 7/2012 | Consonni | B65D 17/4012 220/269 |
| 2013/0020326 | A1* | 1/2013 | Thielen | B29C 45/1671 220/270 |
| 2017/0253371 | A1* | 9/2017 | Ramsey | B21D 22/22 |
| 2019/0055053 | A1* | 2/2019 | Piech | B65D 17/404 |

FOREIGN PATENT DOCUMENTS

| | | | |
|---|---|---|---|
| DE | 69101477 | T2 | 10/1994 |
| DE | 102013226032 | A1 | 6/2015 |
| EP | 2354022 | B1 | 12/2012 |
| WO | 2011095319 | A1 | 8/2011 |
| WO | 2014150673 | A1 | 9/2014 |

* cited by examiner

METALLIC CAN AND ASSOCIATED CAN LID

TECHNICAL FIELD

The invention relates to a can, in particular to a beverage can, comprising a cylindrical container part and a can lid sealingly connected thereto via a folded joint and having a bounded opening region provided in the lid material of the lid surface, and comprising a two-armed lever member that is intended to open this opening region and that is fixedly connected to the lid material, in particular via a rivet connection or a weld connection.

BACKGROUND

Metallic cans of this kind are used worldwide to a very great degree, i.e. in volumes of a number of billions per year. They can be manufactured simply and inexpensively and allow a space-saving stacking while ensuring the required leak tightness under all practically occurring environmental conditions. The opening of the cans by the consumer is made possible by a simple upward pivoting of the long arm of the lever member.

In view of the extremely high volumes of cans produced and consumed annually, the manufacturing costs of such cans play a very large role, with, in addition to the recycling capability, an energy balance being aimed for which is as good as possible in connection with the materials used.

The known cans, in particular beverage cans, comprise aluminum alloys, with it being customary to use the alloy aluminum 3000 for the cylindrical can part and the alloy aluminum 5000 for the lid part since the technical demands on the materials used with the can part and the lid part are different. As part of a reduction in material consumption or in can weight, it has already been possible to reduce the material thickness of the can wall down to approximately 0.09 mm, and indeed while using the alloy aluminum 3000 that is also less expensive than the alloy aluminum 5000 that is typically used as the lid material. The wall thickness of the lid material has to be at least twice as much as the material thickness of the can wall to ensure the required compressive strength of the can despite the notch to be formed in the can material to provide a tear groove. This stamping or notching bounds the opening region and has a depth that typically corresponds to approximately half the material thickness of the can lid. All the demands on the can lid with respect to the opening criteria and the leak tightness can be satisfied by the use of the higher-quality alloy aluminum 5000.

It is the object of the invention to design a can, and in particular a can lid to be connected to the cylindrical part of the can, such that the general production costs can be reduced in addition to a targeted further weight reduction. The opening procedure of the can should moreover be facilitated, i.e. should be able to be carried out with reduced force in comparison with conventional cans and otherwise all the advantages of known cans should be maintained.

SUMMARY

This object is substantially satisfied in accordance with the invention in that the opening region of the lid surface formed as a tongue tab is delineated by a tear line extending over the tab periphery in the form of a material weakening or of an at least partial material perforation and the tongue tab base connected to the lid surface forms a pivot bearing that becomes effective during the opening procedure; in that the lower side of the can is coated, in particular over the full surface, with a plastic material, in particular a plastic film, in a firmly adhering manner, and this coating of the tear line that covers the tear line is weakened in an adjacent manner, in particular notched and preferably at least partly notched open; and in that the container part and the can lid at least substantially comprise the same aluminum alloy.

The opening region of the lid surface is preferably separated from the lid surface by a microgap, in particular a stamped gap, extending over the tab periphery and the container part and the can lid preferably likewise comprise the same aluminum alloy, in particular the alloy aluminum 3000, preferably 3104, with the material thickness of the can lid being substantially the same as the material thickness of the container part and preferably not exceeding at least twice the value of the material thickness of the container part.

It is essential for the solution in accordance with the invention that the demands made on the can lid with respect to leak tightness and compressive strength are at least largely satisfied by the layer of plastic material, in particular a firmly adheringly attached plastic film, provided at the lower lid side and that due to the specific design of this plastic layer in the region of the tongue tab periphery, an opening of the can is possible in a conventional manner, and indeed in particular with smaller force when the notch bounding the opening region is particularly deep or is partly perforated or above all when a microgap is provided instead of a notch.

In addition to the saving in production costs achieved by material selection and weight reduction with a simultaneous improvement of the handling properties in practice use, it is furthermore of essential importance that it is no longer necessary to use a special material for the lid material, for example an aluminum alloy of the 5000 series, in particular the alloy 5182, since now an inexpensive recycling material or the same recycling material can also be used for the lid material on which no special demands have to be made with respect to strength and the possibility of introducing an always safely functioning tear groove. The unity of the aluminum material used for the can part and the lid part also represents an advantage in recycling procedures.

Although the invention can also be implemented using a notch for fixing and bounding the tongue tab in the aluminum material used for the lid, it is of advantage if, instead of a notch, a microgap is used, and indeed preferably in a manner such that the tongue tab of the metallic can lid is separated from the cover surface surrounding it by a cutting procedure, in particular by a stamping procedure, while forming mutually engaging projections and recesses, and such that the tongue tab and the lid surface adjacent thereto are connected via the projections and recesses in a shape-matched and force-transmitting manner while forming the microgap, with the leak tightness of the filled and opened can being ensured by the inwardly disposed plastic coating or film having a thickness preferably in the range of approximately 1/10 mm to 2/10 mm.

The projections and recesses are in particular coupled via undercuts and the lid surface is concavely formed in the region of the tongue tab, which has the consequence that the pressing in the microgap is increased by the internal container pressure.

The plastic layer provided at the lower side of the lid is preferably formed by a plastic film that forms a separate molded blister part before its sealing with the lower side and the notch or partial notch opening decisive for the can opening procedure is already provided in said molded blister part.

On a design of a can lid in which the opening region is pivoted into the interior of the can during the opening procedure, the notch in the plastic film is arranged radially outside the microgap and slightly spaced apart from the microgap.

With a can lid in which the opening region is outwardly pivoted during the opening procedure, the notch in the plastic material or in the plastic film is provided radially within the microgap and slightly spaced apart from the microgap.

The invention is also explicitly directed to a can lid of the above-described design possibilities that can be handled separately from the can part and that is only connected to the can part after filling the can.

BRIEF DESCRIPTION OF THE DRAWINGS

The invention will be described in more detail in the following with reference to an embodiment and to the drawing; there are shown in the drawing FIG. 1 an only sectionally and schematically shown can with a can lid configured in accordance with the invention.

DETAILED DESCRIPTION

Figure 1:
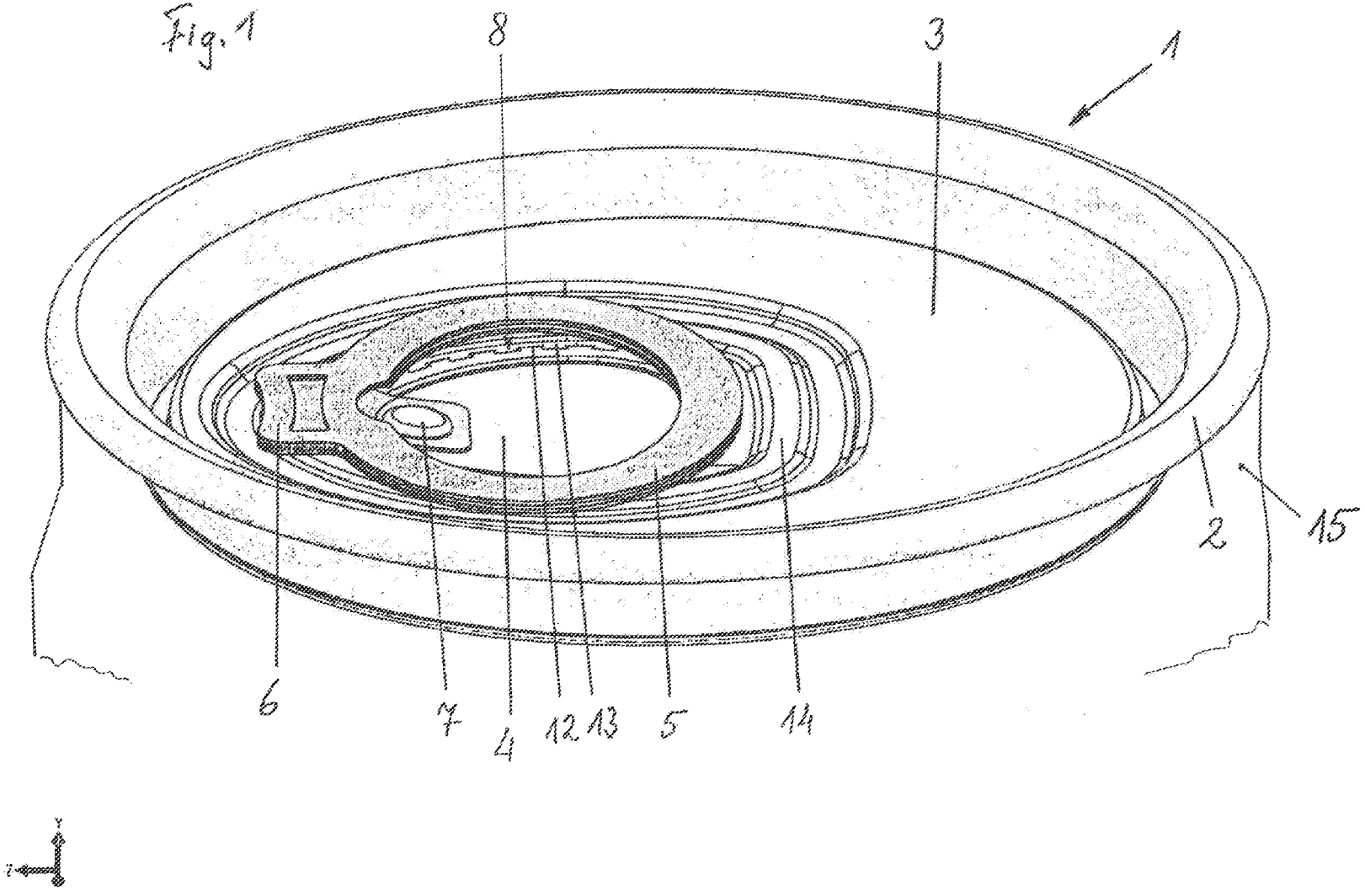

The representation in accordance with FIG. 1 shows an only sectionally shown container part 15 that is connected to a can lid 1 via a flange rim or folding rim 2. The can lid 1 is provided with a tear closure that can generally be of any desired known design, but preferably has one of the aspects described within the framework of this application. They can in this respect be both non-reclosable embodiments and reclosable embodiments such as are described, for example in EP 2 354 022 B1, in PCT/EP2016/057225 or in DE 10 2016 103 801.6.

Unlike known cans comprising aluminum alloys, in particular beverage cans, no aluminum alloy is used that substantially differs from the material of the container part 15 for the can lid 1 in accordance with the invention, but the same aluminum alloy is preferably used.

This is made possible by the special design of the can lid 1 and of the associated tear closure.

With conventional beverage cans of aluminum alloys, an alloy of the aluminum 3000 series is used for the container part 15, with wall thicknesses of 0.09 mm already being able to be achieved with this material as part of the always targeted weight saving. As a rule, an alloy of the aluminum 5000 series is used as the material for the can lid, with a much higher wall thickness being required in comparison with the container part to be able to realize the material notch along the tear line required for the tear closure and in this respect simultaneously to ensure the demands on the compressive strength at internal pressures of at least 6.3 bar.

It becomes possible by the design in accordance with the invention of the can lid and of the tear closure to use substantially the same aluminum alloy for the container part 15 and the can lid 1, and preferably the same aluminum alloy, namely the aluminum alloy used for the container part, in particular from the aluminum 3000 series, and preferably 3104.

This is achieved, on the one hand, by the use of a plastic coating at the inner can side ensuring the compressive strength and the leak tightness of the can and, on the other hand, by the special design of this plastic coating and its interaction with the design of the tear line in the can lid. Although this tear line is preferably configured as a microgap, it forms part of the invention to use, instead of a microgap, a tear line, that is perforated for example, or a pronounced notch that could alone not produce the required compressive strength.

FIG. 1 shows a preferred embodiment of a can 15 in accordance with the invention with a can lid 1 in a schematic plan view. The can lid is provided at its peripheral region with a bead rim 2 in a conventional manner, wherein the region disposed within the bead rim 2 is formed by a lid surface 3 that has an opening region 4 formed as a tongue tab offset with respect to the center. This can lid preferably comprising an aluminum alloy of the 3000 series is provided, surrounding the opening region 4, with a stiffening region 14 formed by material deformation. The same aluminum alloy is preferably also used for the container part 15.

A two-armed lever 5, 6 is connected, in particular riveted or welded, to the opening region 4 or to the tongue tab of the can lid such that a fixed connection point 7 results. This connection point 7 is disposed in the marginal region of the opening region 4, i.e. opposite the tongue base connected to the lid surface 3 and the two-armed lever comprises a shorter region and a longer region, wherein the longer region is preferably formed by an easily grippable ring tab 5 and the shorter region is formed by a supporting limb 6 that is supported on a part of the stiffening region 14 of the can lid on the upward pivoting of the longer lever. The two-armed lever 5, 6 lies substantially in parallel with the lid surface 3 in the starting state.

The tongue tab forming the opening region 4 is connected in a shape-matched and force-transmitting manner to the lid surface 3 via projections 12 and recesses 13 while forming a microgap 8 and preferably via suitable undercuts of these parts, and indeed with the exception of the region of the tongue base 7 where the opening region 4 and the lid surface 3 are connected in a metallic manner such that an upward pivoting of the tongue tab 4 is made possible by means of the lever practically via a kind of folding joint 9 on the opening of the can and the tongue tab and the lever can then move into a position of rest outside the inner can space while releasing the opening.

The required leak tightness or compressive strength of the can lid is ensured despite the lack of a continuous metallic connection between the lid surface 3 and the opening region 4 in the region of the toothed arrangement by a plastic material, in particular a plastic film, that is applied in particular over the whole surface, to the lower side of the metallic lid and that is attached or sealed to the lower lid side in a firmly adhering manner. The coating has a pronounced weakening 14, in particular a notch or partial opening notch, directly adjacent to and disposed within the opening line or the microgap such that on the opening of the can lid and on the pulling up of the tongue tab 4, the narrow region of the plastic film covering the microgap is practically peeled off from the material and thus an opening of the can is made possible that takes place with a small exertion of force.

To achieve this design that precludes any formation of metal splinters on the opening of the can lid, the opening region or the tongue tab is separated from the surrounding lid surface by a cutting procedure or preferably by a punching procedure on the production of the can lid, wherein the splinters or microparticles that are thereby produced can be eliminated completely and free of problems as part of the production process. The tongue tab, that is still connected via its base to the lid surface 3 is pressed back into the lid surface plane directly after its punching out such that the original appearance practically again results for the lid surface, but now with a microgap produced by the punching procedure.

Mutually engaging projections 12 and recesses 13 are preferably produced in the stamping procedure instead of a linear microgap, such as can be seen from FIG. 1.

In this case, the two initially partly separated components are again joined to one another in a shape-matched manner directly after the punching procedure such that the can lid can be handled in further production steps in the same way as conventional can lids that only have a weakening groove.

The processes of separating and joining together take place directly after one another, i.e. after the punching stroke the shape-matched joining together of both parts to form a total part takes place in the return stroke. The shape-matched and force-transmitting connection between the two regions is achieved by a suitable shaping or by using undercuts that ensures a sufficient mutual mechanical connection such that the required coating procedures or the process of the application of the film to the lower side can also be carried out as with a uniform part.

Instead of the toothed arrangement shown in the drawing, different, optionally simpler, gap line extents can be provided in accordance with the invention in the punching procedure, wherein, however, the opening region or the tongue tab in every case remains connected to the lid surface 3 via the pivot bearing region 9 and the microgap is covered by the plastic film disposed at the inner side and provided with a notch. The plastic film, which can be an PP film and which reacts to the sealing wax provided at the metal during sealing, is in particular manufactured as a separate molded blister part in which the notch is already provided. If the film has a thickness e.g. of approximately 2/10 mm, a weakening to 1/100 mm takes place in the notch.

Figure 2:
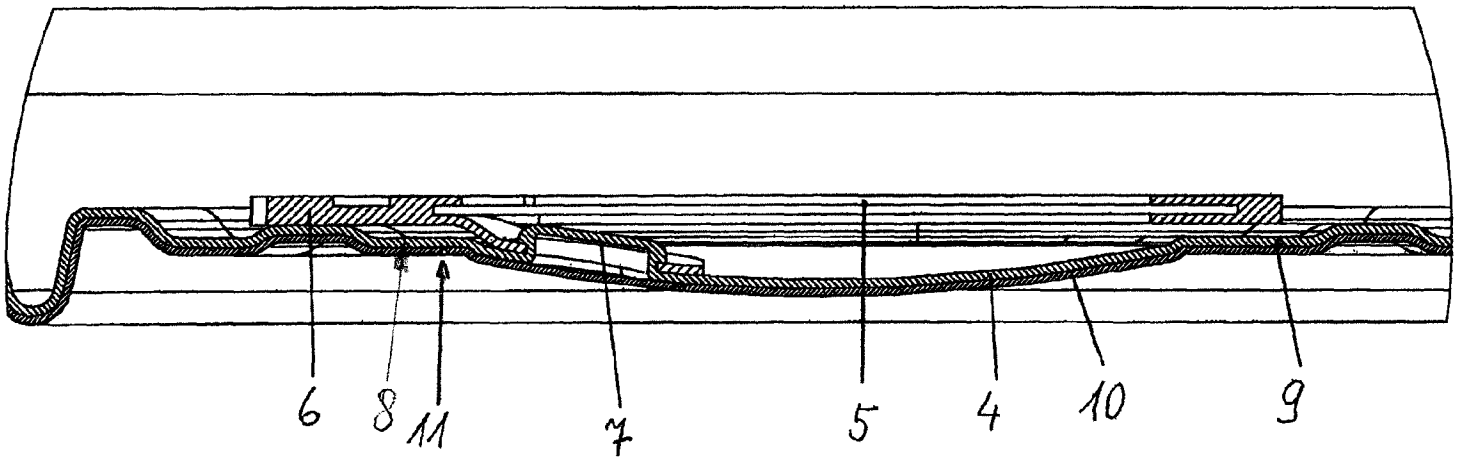
FIG. 2 a sectional representation along a diameter of the can lid in accordance with FIG. 1.

The somewhat enlarged part representation in accordance with FIG. 2 above all shows, in addition to the embodiment of the connection point 7 in the manner of a rivet connection, the application of the plastic film 10 over the full surface to the lower side of the can lid and in particular the formation of the weakening line 11 in the plastic film 10 preferably achieved by a notching and/or regionally by a notching open, said plastic film extending within or outside the microgap about the opening region 4 depending on the embodiment, with the spacing between the weakening line and the microgap being dimensioned such that, on the one hand, the demands on the compressive strength of the can are satisfied and, on the other hand, the already mentioned peeling effect results during the opening procedure.

Since, unlike with known can lids, no special demands have to be made on the aluminum alloy material of the can lid 1 in connection with notches producing material weakening and with compressive strength, the same aluminum alloy can practically be used with preferably the same material thickness both for the container part and for the can lid. No special, in particular high-quality, alloy material such as an alloy of the aluminum 5000 series thus also has to be used in the can production, which produces simplifications and above all cost savings since the same recycling material can thus be used for the entire can.

REFERENCE NUMERAL LIST

1 can lid
2 bead rim
3 lid surface
4 opening region, tongue tab
5 lever arm
6 lever arm
7 fastening point, tongue base
8 microgap
9 pivot bearing region
10 plastic film
11 weakening line, notch
12 projection
13 recess
14 stiffening region
15 container part

The invention claimed is:

1. A can comprising a cylindrical container part and a can lid, the can lid being sealingly connected to the cylindrical container part via a folding joint and the can lid having a bounding opening region provided in a lid material of the lid surface, and the can lid comprising a two-armed lever member intended for opening this opening region, said lever member being fixedly connected to the lid material, wherein the opening region configured as a tongue tab is delineated from the lid surface by a tear line in the form of a material weakening or of an at least partial material perforation extending over the tab periphery and with a base of the tongue tab connected to the lid surface forming a pivot bearing that becomes effective during the opening procedure;

wherein the lower side of the lid is coated with a coating or film of plastic material in a firmly adhering manner, and this coating or film covering the tear line is weakened adjacent to the tear line between the tongue tab and the lid surface; and wherein the container part and the can lid at least substantially comprise the same aluminum alloy.

2. The can in accordance with claim 1, wherein the can is a beverage can.

3. The can in accordance with claim 1, wherein the lower side of the lid is coated over its full surface with the plastic material.

4. The can in accordance with claim 1, wherein the lower side of the lid is coated with a plastic film.

5. The can in accordance with claim 1, wherein the coating or film covering the tear line is weakened in a notched manner.

6. The can in accordance with claim 5, wherein the coating or film covering the tear line is at least partly notched open.

7. The can in accordance with claim 1, wherein the opening region is separated from the lid surface by a microgap extending over a tab periphery.

8. The can in accordance with claim 7, wherein the microgap is a stamped gap.

9. The can in accordance with claim 7, wherein the tongue tab of the can lid is separated from the lid surface surrounding it while forming mutually engaging projections and recesses by a cutting procedure; and wherein the tongue tab and the lid surface adjoining it are connected via the projections and the recesses in a shape-matched and force-transmitting manner while forming the microgap, with the leak-tightness of the filled and unopened can being ensured by the inwardly disposed plastic coating or film.

10. The can in accordance with claim 9, wherein the tongue tab of the can lid is separated from the lid surface surrounding it while forming the mutually engaging projections and recesses by a punching procedure.

11. The can in accordance with claim 9, wherein the coating or film of plastic material has a thickness in the range from approximately 1/10 mm to 2/10 mm.

12. The can in accordance with claim 9, wherein the projections and the recesses are coupled via undercuts.

13. The can in accordance with claim 7, wherein the lid surface is formed concavely in the region of the tongue tab and the pressing in the microgap is increased by the internal container pressure.

14. The can in accordance with claim 1, wherein the plastic film provided at the lower side of the can lid forms a separate molded blister part prior to its sealing to the lower side and a notch or a partial notching open is already provided in said molded blister part.

15. The can in accordance with claim 1, wherein the container part and the can lid comprise the same aluminum alloy and the material thickness of the can lid is substantially the same as the material thickness of the container part.

16. The can in accordance with claim 15, wherein the material thickness of the can lid does not exceed at least twice the value of the material thickness of the container part.

17. The can in accordance with claim 15, wherein the material thickness of the container part is disposed in the range of approximately 0.1 mm and less.

18. The can in accordance with claim 1, wherein an alloy of the "aluminum 3000" series is used as the aluminum alloy.

19. The can in accordance with claim 8, wherein the alloy 3104 is used as the aluminum alloy.

20. A can lid comprising part of a folding joint configured to be connected to a can, the can lid further comprising a bounding opening region provided in a lid material of the lid surface, and comprising a two-armed lever member intended for opening this opening region, said lever member being fixedly connected to the lid material, wherein the opening region configured as a tongue tab is delineated from the lid surface by a tear line in the form of a material weakening or of an at least partial material perforation extending over the tab periphery and with a base of the tongue tab connected to the lid surface forming a pivot bearing that becomes effective during the opening procedure;

wherein the lower side of the lid is coated with a coating or film of plastic material in a firmly adhering manner, and this coating or film covering the tear line is weakened adjacent to the tear line between the tongue tab and the lid surface; and wherein the container part and the can lid at least substantially comprise the same aluminum alloy, wherein the can lid is configured as a separate component that is designed for the subsequent leak tight connection to the can that substantially comprises the same material.

* * * * *